United States Patent [19]

Werner

[11] Patent Number: 4,860,987

[45] Date of Patent: Aug. 29, 1989

[54] ADJUSTABLE TELESCOPIC DEVICES

[75] Inventor: Per G. Werner, Spro, Norway

[73] Assignee: Mec-Lift A.S., Fagerstrand, Norway

[21] Appl. No.: 835,118

[22] PCT Filed: Jun. 14, 1985

[86] PCT No.: PCT/NO85/00034

§ 371 Date: Feb. 18, 1986

§ 102(e) Date: Feb. 18, 1986

[87] PCT Pub. No.: WO86/00205

PCT Pub. Date: Jan. 16, 1986

[30] Foreign Application Priority Data

Jun. 18, 1984 [NO] Norway ..... 842441
Mar. 29, 1985 [NO] Norway ..... 851295

[51] Int. Cl.[4] ..... A47C 3/24

[52] U.S. Cl. ..... 248/405; 297/345; 297/348; 248/418

[58] Field of Search ..... 248/405, 412, 406.1, 248/406.2, 415, 416, 418; 297/345, 347, 348; 254/99, 102, 103

[56] References Cited

U.S. PATENT DOCUMENTS

| | | | |
|---|---|---|---|
| 506,200 | 10/1893 | Archer | 297/348 |
| 1,546,905 | 7/1925 | Kopf | 297/347 |
| 1,974,687 | 9/1934 | Morrison | 254/102 |
| 2,501,976 | 3/1950 | Vitek . | |
| 2,674,301 | 4/1954 | Harting . | |
| 3,711,054 | 1/1973 | Bauer | 248/161 |
| 3,799,485 | 3/1974 | Wolters | 248/406.1 |
| 3,923,280 | 12/1975 | Good | 248/405 |
| 4,315,613 | 2/1982 | Godwin | 248/406.2 |
| 4,318,526 | 3/1982 | Werner | 248/412 |
| 4,379,540 | 4/1983 | French | 248/406.2 |
| 4,493,469 | 1/1985 | Holobaugh | 297/348 |
| 4,494,721 | 1/1985 | Trinkel | 248/406.2 |
| 4,598,892 | 7/1986 | Franckowiak | 297/348 |
| 4,613,106 | 9/1986 | Tornero | 297/347 |

FOREIGN PATENT DOCUMENTS

| | | | |
|---|---|---|---|
| 0021813 | 2/1981 | European Pat. Off. . | |
| 2533147 | 2/1977 | Fed. Rep. of Germany | 248/406.1 |
| 2904072 | 8/1980 | Fed. Rep. of Germany | 248/406 |
| 2210902 | 7/1974 | France . | |
| 303985 | 12/1954 | Switzerland | 297/348 |
| 615332 | 1/1980 | Switzerland . | |

OTHER PUBLICATIONS

Western Electric, Technical Digest, No. 59, Jul. 1980, J. T. Colfer, p. 5.

*Primary Examiner*—Gary L. Smith
*Assistant Examiner*—Eric K. Nicholson
*Attorney, Agent, or Firm*—Fleit, Jacobson, Cohn, Price, Holman & Stern

[57] ABSTRACT

A spindle for working chairs having an adjustable height comprises an inner tube (1) which is slidably inserted in an outer tube (3) and extends therefrom and is adapted to transmit the load from the chair seat to the outer tube. The inner tube (1, 1', 1'') is lockable in a plurality of positions relative to the outer tube. The load is transmitted from the inner to the outer tube through a threaded spindle (10, 10', 10'') which is coaxial with the tubes and is rotatably mounted in the outer tube (3), and the threads of which engage a nut (8) which is stationary with respect to the inner tube. The threaded connection formed between the nut and the spindle has a pitch which is sufficiently large for the connection not be self-locking when the nut (8) is moved axially, but still sufficiently small to allow a substantial part of the axial load to be transfered to the threaded spindle (10, 10', 10''). A releasable locking member (**18, 18', 18*a*, 18*b*) preventing rotation of the threaded spindle (10, 10', 10'') relative to the outer tube is provided for locking the telescopic device. The threaded connection is used to provide a spring operated adjustment of the length. For this purpose the outer tube (3) is non-rotatably secured with respect to the inner tube (1, 1', 1''), and a spiral spring (21), i.e. a spring similar to a watch spring, is provided for acting between the outer tube (3) and the spindle (10, 10', 10''**) for rotation thereof in a direction corresponding to a raising of the seat of the chair.

14 Claims, 4 Drawing Sheets

ADJUSTABLE TELESCOPIC DEVICES

CROSS REFERENCE TO RELATED APPLICATION(S)

This United States application stems from PCT International Application No. PCT/N085/00034 filed June 14, 1985.

BACKGROUND OF THE INVENTION

The invention relates to adjustable telescopic devices of the type in which an inner tube is slidably inserted in an outer tube and extends therefrom and is adapted to transmit an axial load to the outer tube, the inner tube being lockable in a plurality of positions relative to the outer tube. The invention has been developed especially for use in spindles for working chairs having an adjustable height, wherein the weight of the user in addition to the weight of the seat and possibly the back of the chair provides the load on the inner tube. However, it is feasible to use the invention in a number of other environments, for instance as adjustable table legs, shuttering supports, braces for agricultural machines etc., wherever there is a need for an adjustment of a height or a length.

The possibility of adjusting the height of working chairs is very important in many situations, especially when the same work-table is used by different persons at different times, a correct seating level being essential for the comfort of the user. For such a possibility to be regularly used when needed it is absolutely necessary that the user can operate the device quickly and from a seated position, even when having no special technical skill.

For this purpose it is usual to use a telescopic device of the type referred to initially. A problem in this connection is to combine the possibility of easily operating the device with a positive locking in the chosen position. In many such telescopic devices the locking is provided by means of some sort of wedging action provided by axially movable, spring loaded wedges which either force flaps partly cut out from the inner tube radially outwardly against the outer tube or force wedges into the space between the inner and the outer tube. However, unless the telescopic movement is braked in some other way, the locking device must take the full axial load, for instance the weight of a relatively heavy person, and a high locking force is then required. In this respect a difficulty resides in the fact that a small wedge angle, although providing a secure locking, is also heavy to release, whereas a locking using larger wedge angles is less secure. The use of wedge elements between the outer tube and downwardly converging surfaces on the inner tube is referred to already in German Patent Specification 130 366 from 1901, but this patent specification also describes and illustrates another possibility, namely to replace the wedge elements with balls which are actuated from below by a spring loaded disc. In such a device the locking is performed by the balls wedging due to the spring load, the locking becoming firmer the larger the weight with which the seat is loaded, whereas for adjustment movements in released position of the disc only rolling friction has to be overcome. However, an inherent drawback is that the balls when heavily loaded by the weight of the user, will exert a heavy local load on the outer as well as the inner tube, with the result that these tubes may deform and gradually become permanently damaged, with the consequence that the function becomes unsatisfactory and operation of the device from a seated position is no longer possible.

SUMMARY OF THE INVENTION

The object of the present invention is to provide a telescopic device of the type initially referred to, wherein the locking device does not have to resist the full axial load in locked position, thus enabling a simpler structure of the locking device. Consequently, it will also be possible to provide the necessary locking force by means of a relatively weak spring instead of by the axial load, whereby the risk of jamming which can only be released with difficulty, is reduced. Finally, it is an object to provide a telescopic device which can be used both in connection with a fully manual length adjustment and especially in connection with a spring loaded length adjustment, which is especially desirable for working chairs.

The device according to the invention is characterized in that for the transfer of the axial load to the outer tube there is provided a threaded spindle which is coaxial with the tubes and is rotatably mounted in the outer tube and the threads of which engage female threads which are stationary with respect to the inner tube, the threaded connection formed between the female threads and the spindle having a pitch being sufficiently large for the connection not to be self-locking when the inner tube is moved axially, but still sufficiently small to allow a substantial part of the axial load to be transferred to the threaded spindle, and that there is provided a releasable locking member preventing rotation of the threaded spindle relative to the inner tube.

When the locking member is released and the inner tube is moved axially, the threaded spindle will rotate, since the threads are not self-locking, whereby the axial movement is permitted. These threads will still provide a significant resistance to the movement and thereby brake this movement. Consequently, the telescopic device will not suddenly collapse, but instead experience a controlled shortening if the locking should suddenly be released when the device is under load, Furthermore, a substantial part of the load in use will be transferred to the spindle. Although the threads are not self-locking, the rotational moment on the spindle will be relatively small, and to prevent such rotation and thereby obtain a locking of the telescopic device a relatively small braking force on the spindle will be sufficient.

The locking member may have female threads having crests that can engage the crests of the threads on the spindle, said locking member being spring biassed to an engaged position for locking of the spindle. The crests of the female threads in the locking member when in said engaged position can conveniently contact a slightly conical portion of the crests of the threads on the spindle, whereby a wedging action providing a good locking engagement will be obtained, even if the axial force between the spindle and the locking member is small. The locking engagement may be further enhanced, if required, by providing axial flutes on the crests of the threads in the locking member and/or on the threaded spindle.

In order to obtain a suitable spring effect between the inner and the outer tubes there may be provided a spiral spring acting between the outer tube and the spindle, said spring seeking to rotate the spindle in a direction corresponding to an extension of the telescopic device.

At the same time the outer tube must be non-rotatably secured with respect to the inner tube. In combination, an effect is provided which substantially corresponds to that obtained in known chair spindles by means of gas springs, implying that when the locking is released, the telescopic device will be extended if unloaded and shortened if loaded. The device according to the invention including a spiral spring represents a mechanical device meeting the drawbacks associated with gas springs.

BRIEF DESCRIPTION OF THE DRAWINGS

The invention will now be further explained by means of embodiments, reference being had to the drawings, further features of the invention being also disclosed.

DESCRIPTION OF PREFERRED EMBODIMENTS

Figure 1:
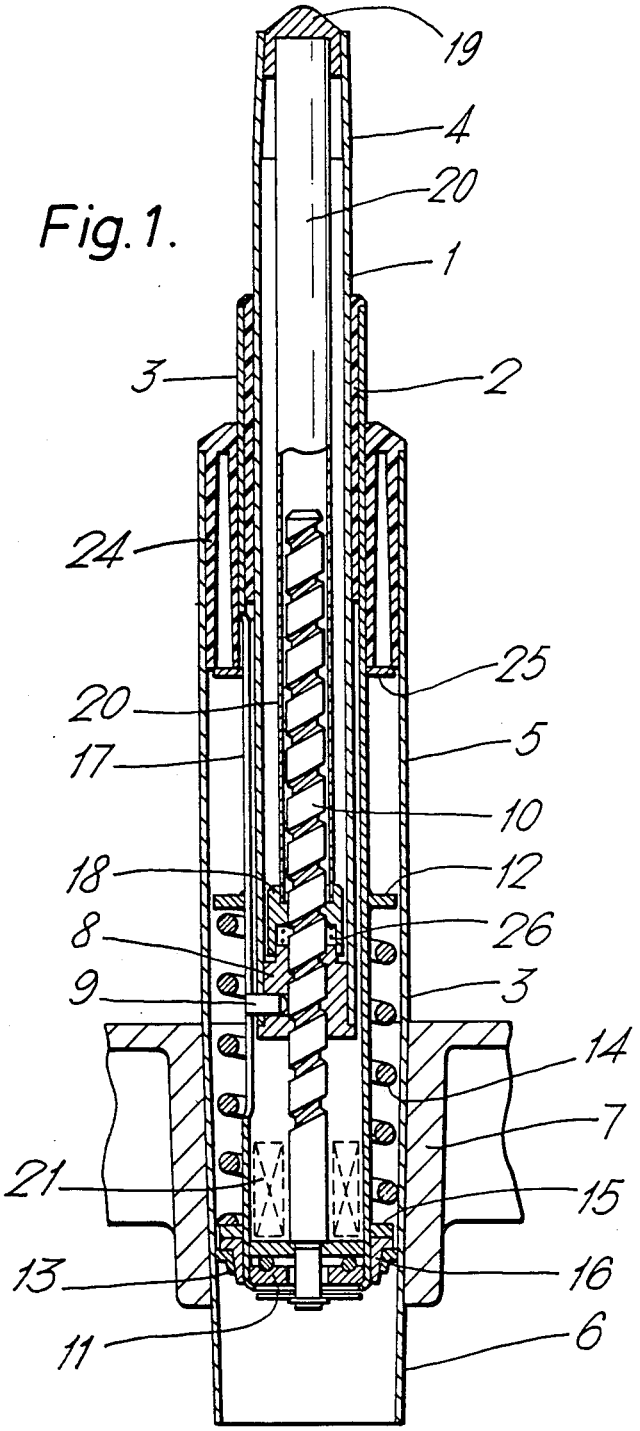
FIG. 1 is an axial section through a chair spindle having a spiral spring for semi-automatic adjustment.

In FIG. 1 the inner tube of the telescopic device is designated by the numeral 1. The inner tube is slidably and vertically guided in a bushing 2 in the outer tube 3 of the telescopic device. A conically tapering terminal portion 4 of the inner tube 1 extends from the upper end of the outer tube 3. On the tapering terminal portion 4 a mating armature or mounting (not illustrated) can be mounted, which mounting may for instance carry a seat, either directly or by means of a tilting armature or the like. At its lower end the telescopic device is surrounded by an outer housing 5 having a lower conical portion 6 which is inserted into the chassis 7 of the chair.

The weight of the seat of a chair and a person sitting thereon is transferred through the inner tube 1 to a nut 8 which is secured on the tube 1 by means of a pin 9. The load is transmitted from the female threads of the nut 8 to a threaded spindle 10 and further through an axial ball bearing 11 to the lower end of the outer tube 3, which is inwardly flanged at its lower end. At a higher level the outer tube 3 carries a flange 12, and the load is transmitted from the outer tube 3 through the flange 12, a helical spring 14 and antifriction members 15, 16 to an inner flange 13 in the housing 5.

The pitch of the threads on the threaded spindle 10 is sufficiently large for the threads not to be self-locking when the nut 8 is moved axially. Thereby, it becomes possible to move the nut 8 in the longitudinal direction for adjusting the telescopic device, the spindle 10 being forced to rotate. In order to lock the telescopic device it is sufficient to prevent rotation of the spindle 10 relative to the inner tube 1. This can be obtained by means of a nut-like locking member 18 which engages the threads on the threaded spindle 10 and is biassed away from the nut 8 by means of a spring 26 provided between the nut 8 and the locking member 18. The nut 8 and the locking member 18 are prevented from rotation relative to each other due to the fact that the line of intersection between a plane perpendicular to the common axis of the nut and the locking member and the guide surfaces therebetween is not a circle, but for instance a polygone. The spring 26 forces the female threads in the locking member 18 into engagement with the upper sides or flanks of the threads on the threaded spindle 10, whereby a frictional force against these flanks sufficient to prevent rotation of the spindle 10 is obtained. The female threads in the locking member 18 are designed so that the locking member can be axially moved towards the nut 8 against the force of the spring 26 for eliminating the braking or locking action. This releasing movement is effected manually by means of a lever (not illustrated), which is mounted in the seat armature and acts on a pressure member 19 which through a distance tube 20 actuates the locking member 18. Thereupon, the seat and the inner tube 1 may be raised or lowered manually while overcoming the frictional force in the threaded connection.

As already mentioned an important advantage of the telescopic device is that it is adapted for use together with a mechanical spring which provides a semi-automatic adjustment of the device. Such a spring is diagrammatically indicated at 21. For the spring to be used for semi-automatic adjustment the inner and the outer tubes must be non-rotatably secured with respect to each other. This is obtained by letting the pin 9 locking the nut 8 to the inner tube 1 extend through a slot 17 in the outer tube 3. Thereby, the inner tube 1 and the nut 8 are also secured against rotation relative to the outer tube 3, while being movable as a unit in the axial direction relative to the outer tube 3 a distance corresponding to the length of the slot 17. The spring 21 is preferably a thin ribbon-shaped spiral spring, the outer end of which is connected to the outer tube 3, the inner end being connected to the threaded spindle 10. It is possible to design the spring 21 so that it will rotate the threaded spindle 10 and raise the inner tube 1 and the chair seat (not shown) when the latter is unloaded or only loaded by a small force. On the other side, if the load is heavier, for instance that of a person sitting on the seat, the nut 8 will be moved downwards, and the spindle 10 will be rotated in the opposite direction, whereby the spring 21 will be tensioned.

Figure 2:
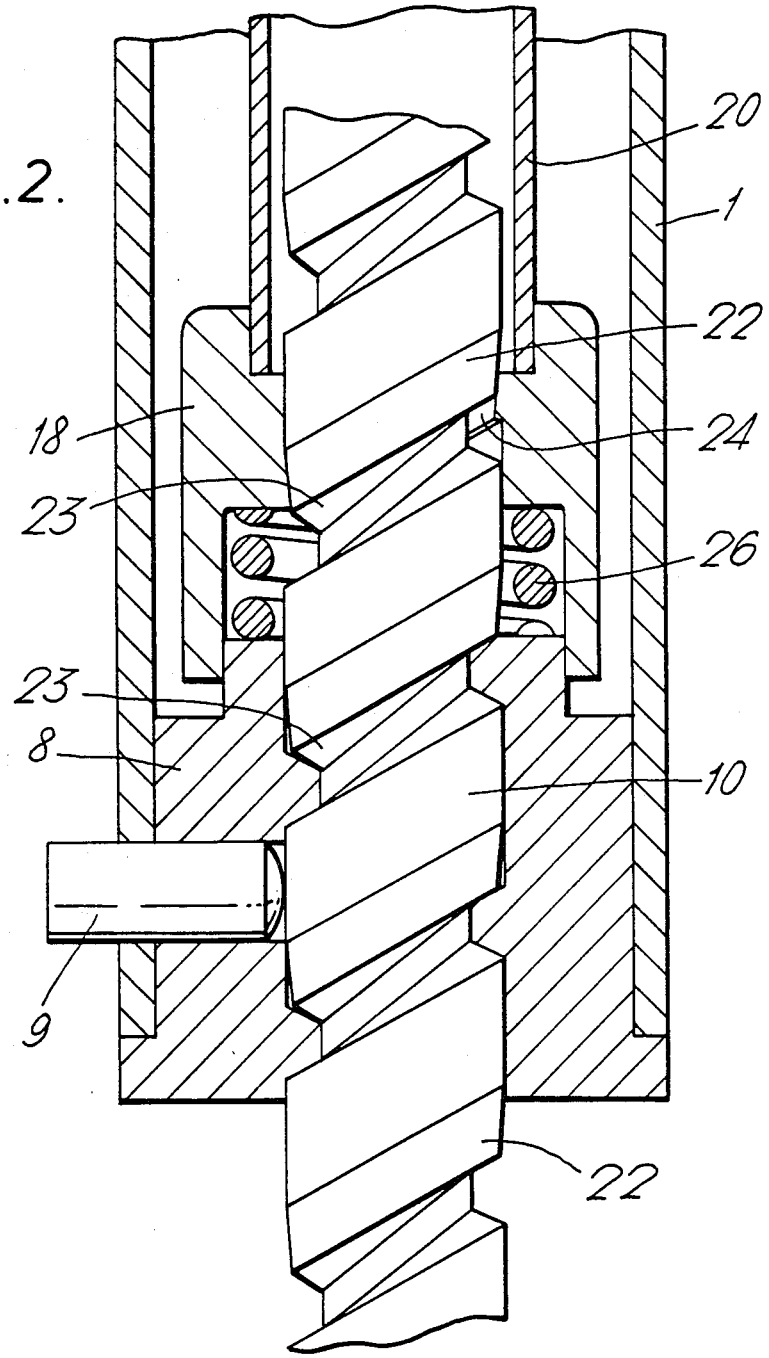
FIG. 2 is a section on a larger scale, illustrating some of the elements of the telescopic device in FIG. 1 in a somewhat modified version.

The embodiment illustrated in FIG. 2 only deviates from the embodiment in FIG. 1 with respect to the engagement between the nut-like locking member 18 and the threads on the threaded spindle 10. In fact, a better locking effect can be obtained when the angle formed by the engagement surfaces with the axis of the spindle is relatively small. The upper flanks of the threads on the threaded spindle 10 can therefore suitably have a radially outer portion 22 which forms such a small angle with the axis of the spindle that it becomes more natural to regard the portion 22 as a slightly conical portion of the crest of the thread. Correspondingly, the locking member 18 will have female threads 24 of a shape which primarily is adapted to the conical portion 22 of the spindle 10. Thus, they do not even have to extend into the groove of the thread and engage the thread portion 23. Instead, the thread portions co-operating with the portions 22 can simply be the crests of the threads in the locking member 18.

Finally, it should be mentioned that the housing 5 can be closed at the upper end by a guiding sleeve 24 which also forms a bearing for the upper end of the outer tube 3. Furthermore, a further outer flange 25 can be secured to the outer tube 3, said flange 25 engaging the lower side of the guiding sleeve 24 when the spring 14 is not compressed. The flange 25 partly prevents the telescopic device from being lifted out of the housing 5 when the seat is lifted, partly provides friction between the flange 25 and the lower side of the guiding sleeve 24, thus preventing the seat from rotating relative to the chassis when there is no load on the seat. Thus, the seat will not rotate when a seated person rises therefrom.

Figure 3:
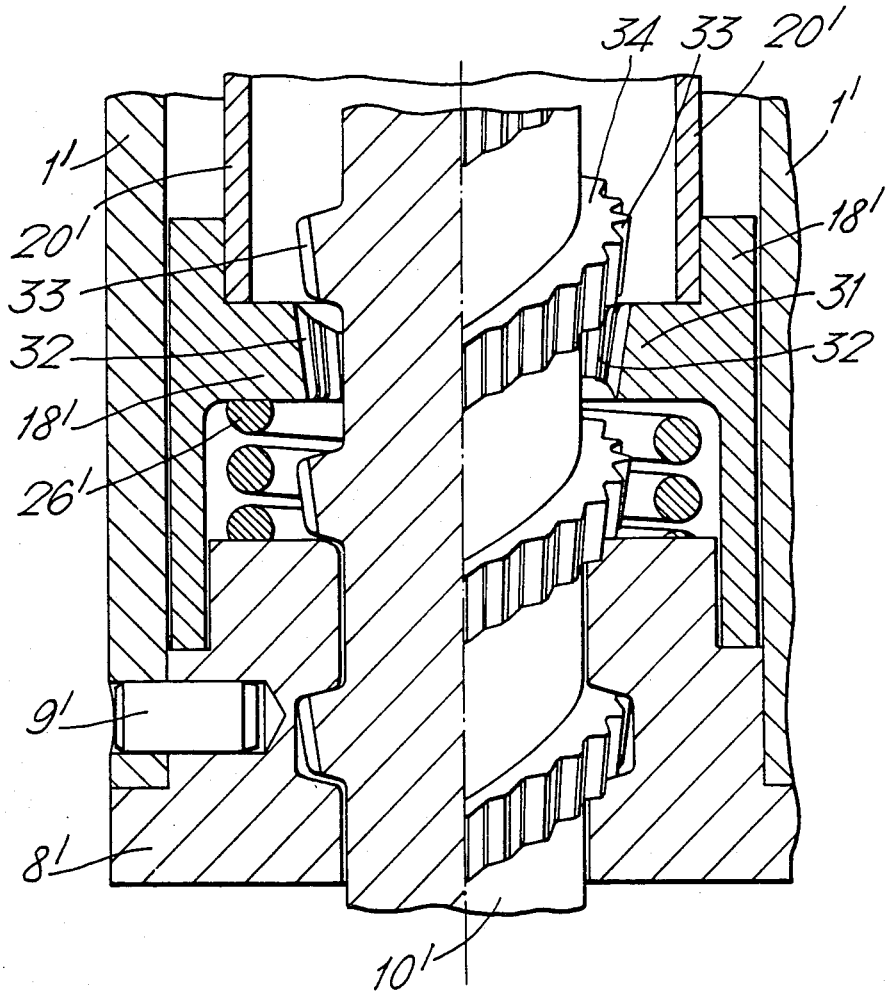
FIG. 3 is a section similar to that in FIG. 1, but illustrating another embodiment of the threaded spindle and the co-operating locking member.

In the embodiment illustrated in FIG. 3 the various elements are designated by the same reference numerals as in FIGS. 1 and 2 with the addition of a prime. Thus, FIG. 3 illustrates an inner tube 1', a threaded spindle 10', a nut 8', a pin 9', a locking member 18', a helical spring 26', and a distance tube 20'. The function and co-operation of these elements with other members and elements not illustrated in FIG. 3, are the same as in the embodiments in FIGS. 1 and 2.

According to FIG. 3 the locking member 18' has female double threads 31, the crests of which are provided with flutes 32. These flutes 32 can be engaged with corresponding flutes 33 in the crests of external threads 34 on the threaded spindle 10'. Naturally, also the threads 34 on the threaded spindle 10' are double threads. The spring 26' forces the locking member 18' upwardly to bring the flutes 32 and 33 into mutual engagement. If the flutes 32 are case hardened, they may also come into locking engagement with the crests of the threads 34 by biting into these crests, even in absence of the flutes 33. The crests of the threads in the locking member 18' as well as on the threaded spindle 10' form a small angle with the spindle axis. Thereby, the movement of the locking member 18' for engagement with the spindle 10' and for the releasing of this engagement is facilitated. For the engagement to be fully released it is, of course, necessary either to move the locking member 18' in the axial direction sufficiently far for the threads 31 not to face the threads 34, or for the flutes 32, 33 to clear each other. This will depend on the angle between the crest of the thread and the axis of the spindle, and on the depth of the flutes.

In contrast to the pin 9, the pin 9' only engages the inner tube 1' and not the outer tube. Instead, the outer tube can be in non-rotatable but axially displaceable engagement with the inner tube in other manners, which, however, are not shown. Alternatively, such a connection can be dispensed with, but in such a case the spindle 10' cannot be spring loaded for rotation to obtain a semi-automatic length adjustment.

When mating flutes 32, 33 are used, the adjustment of the length or height cannot be stepless, but must be effected in steps corresponding to the ratio between the pitch and the number of flutes for each revolution.

Figure 4:
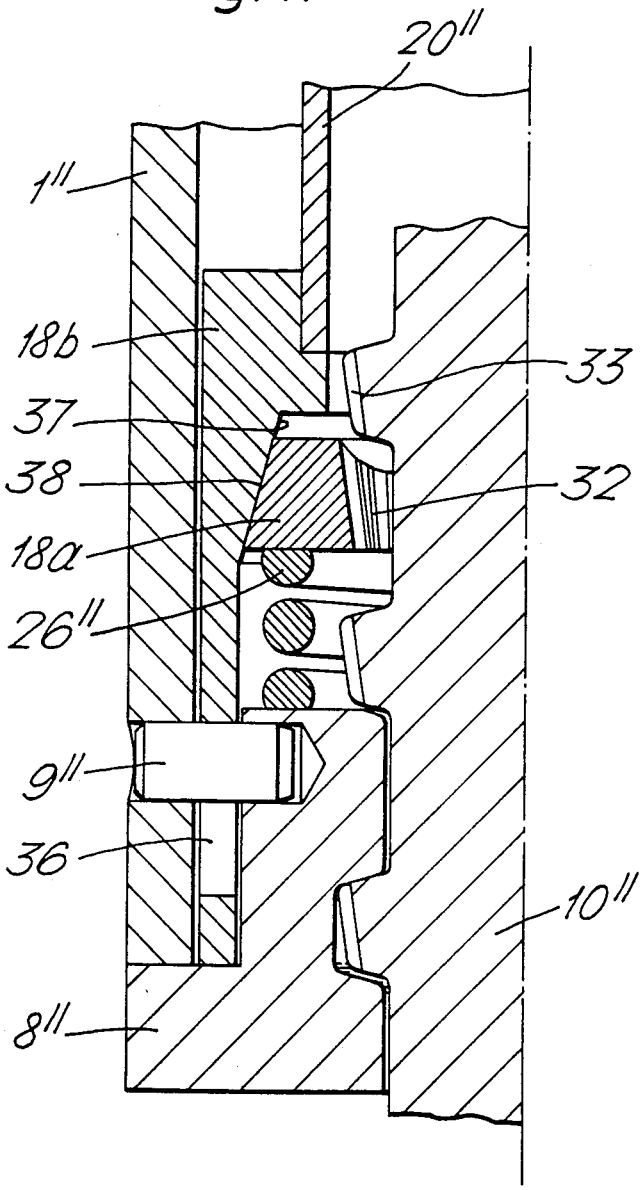
FIG. 4 is a section similar to one half of FIG. 3, but illustrating a modification of the embodiment therein.

In the embodiment in FIG. 3 it may be difficult to engage the flutes 32 and 33 when the spindle 10' is rotating fast, since the locking member 18' is prevented from rotating. In order to obtain a soft engagement including a frictional braking effect, it is possible to use the modification illustrated in FIG. 4, in which the locking member is split into an engagement element **18*a* and a friction sleeve 18*b*. Similar to the locking members 18 and 18', the friction sleeve 18*b* is non-rotatable relative to the nut 8''. In the case of the friction sleeve 18*b* this is obtained due to the fact that the sleeve is provided with a slot 36, the width of which corresponds to the diameter of the pin 9''. The friction sleeve 18*b* has a conical friction surface 37 which co-operates with a corresponding friction surface 38 on the engagement member 18*a***.

When the friction sleeve **18*b* and consequently the engagement member 18*a* are pressed fully to their bottom positions in engagement with the nut 8'', the spindle 10'' can rotate fast, depending on the size of the force to which the spindle is subjected, either by the spring 21 or by an axial force acting through the nut 8''. If the releasing force from the pressure member 19 through the distance tube 20'' is suddenly released, the engagement member 18*a* with its flutes 32 will engage the flutes 33 on the spindle 10''. However, it will be out of engagement with the friction sleeve 18*b* and only slightly engage the pressure spring 26''. Therefore, the engagement member is able to rotate. When the vertical movement of the friction sleeve is halted, the engagement member will be braked by friction against the surface 37**. The effect is analogous to that provided by a synchronizing ring connection in a gear box.

The advantage of such an embodiment over the embodiment according to FIG. 2, in which the engagement between the locking member 18 and the spindle 10 is a frictional engagement instead of a teeth or flute engagement, is that the frictional force acts on a larger lever arm. Furthermore, frictional surfaces which are separate from the threads may more readily be provided with a suitable friction coating.

It will be understood that the invention can be realized in many ways other than those described above with reference to the drawings. Apart from being used in other connections than for chair spindles as mentioned above, in which case the design will be adapted to the intended use, the use of the invention is not restricted to embodiments in which the telescopic tubes have a circular cross-section, polygonal sections also being possible. It will also be possible to use the invention in connection with telescopic devices having more than two telescoping tubes. Finally, it will be understood that there are several other possible embodiments of the locking device. As a further example it may be mentioned that the threaded spindle 10 can be crossthreaded, i.e. it can have two threads of opposite hand, the nut 8 and the locking member being in engagement with one thread each. When the inner tube 1 is moved in the axial direction, the locking member will then rotate at a larger speed of rotation than the spindle, and locking can then be obtained by providing a frictional connection or another locking engagement between the locking member and the nut 8.

I claim:

1. An adjustable telescopic device comprising an inner tube slidable in an outer tube and extending therefrom, a threaded spindle coaxial with the tubes and rotatably mounted in the outer tube, said spindle serving to transmit an axial load from the inner tube to the outer tube, a load transmitting member fixed with respect to the inner tube and non-rotatably connected to the outer tube, said member having female threads engaging the spindle threads and forming a threaded connection with the spindle having a pitch allowing an axial load on said member to move the member axially with respect to the spindle so as to rotate the latter, said pitch also allowing axial load to be transferred to the spindle, and releasable locking means for preventing rotation of the spindle relative to the inner tube the locking means being non-rotatably connected with the load transmitting member and acting directly on the spindle.

2. An adjustable telescopic device comprising an inner tube slidable in an outer tube and extending therefrom, a threaded spindle coaxial with the tubes and rotatably mounted in the outer tube, said spindle serving to transmit an axial load from the inner tube to the outer tube, a load transmitting member fixed with respect to the inner tube and non-rotatably connected to the outer tube, said member having female threads engaging the spindle threads and forming a threaded connection with the spindle having a pitch allowing an axial load on said member to move the member axially with respect to the spindle so as to rotate the latter, said pitch also allowing axial load to be transferred to the spindle, and releasable locking means for preventing rotation of the spindle relative to the inner tube, wherein the locking means is connected with the load transmitting member and cooperates with the threads on the spindle.

3. An adjustable telescopic device comprising an inner tube slidable in an outer tube and extending therefrom, a threaded spindle coaxial with the tubes and rotatably mounted in the outer tube, said spindle serving to transmit an axial load from the inner tube to the outer tube, a load transmitting member fixed with respect to the inner tube and non-rotatably connected to the outer tube, said member having female threads engaging the spindle threads and forming a threaded connection with the spindle having a pitch allowing an axial load on said member to move the member axially with respect to the spindle so as to rotate the latter, said pitch also allowing axial load to be transferred to the spindle, and releasable locking means for preventing rotation of the spindle relative to the inner tube, wherein the locking means is provided with female threads having crests that engage the crests of the threads on the spindle, said locking member being spring biased to an engaged position and movable against the force of the spring to eliminate the locking.

4. A device as claimed in claim 3, wherein the female threads in the locking means when in said engaged position contact a slightly conical portion of the crests of the threads on the spindle.

5. A device as claimed in claim 4, wherein the crests of one of the threads of a group consisting of the threads in the locking means and the threads on the threaded spindle are provided with substantially axial flutes for enhancing the force of engagement.

6. A device as claimed in claim 5, wherein the crests of the threads in the locking means and the threads on the spindle are provided with mating flutes for mutual engagement.

7. A device as claimed in claim 6, wherein the locking means is split into an engagement element having flutes engaging flutes in the threads spindle and a friction sleeve having a conical friction surface intended for frictional engagement with a corresponding friction surface on the engagement element.

8. An adjustable telescopic device comprising an inner tube slidable in an outer tube and extending therefrom, a threaded spindle coaxial with the tubes and rotatably mounted in the outer tube, said spindle serving to transmit an axial load from the inner tube to the outer tube, a load transmitting member fixed with respect to the inner tube and non-rotatably connected to the outer tube, said member having female threads engaging the spindle threads and forming a threaded connection with the spindle having a pitch allowing an axial load on said member to move the member axially with respect to the spindle so as to rotate the latter, said pitch also allowing axial load to be transferred to the spindle, and releasable locking means for preventing rotation of the spindle relative to the inner tube, wherein all the threads are double start threads.

9. An adjustable telescopic device comprising an inner tube slidable in an outer tube and extending therefrom, a threaded spindle coaxial with the tubes and rotatably mounted in the outer tube, said spindle serving to transmit an axial load from the inner tube to the outer tube, a load transmitting member fixed with respect to the inner tube and non-rotatably connected to the outer tube, said member having female threads engaging the spindle threads and forming a threaded connection with the spindle having a pitch allowing an axial load on said member to move the member axially with respect to the spindle so as to rotate the latter, said pitch also allowing axial load to be transferred to the spindle, and releasable locking means for preventing rotation of the spindle relative to the inner tube, wherein the outer tube is non-rotatably secured with respect to the inner tube and spiral spring is connected to the outer tube and the spindle for exerting a rotating force on said spindle.

10. A mechanically adjustable support column comprising:

(a) a support tube having a mounting cylinder telescopically mounted in an open end thereof in axially adjustable relation thereto;

(b) a threaded support rod mounted in axially fixed, rotatable relation to said support tube;

(c) an energy storing spring means connecting one end of said support rod with the end of said support tube opposite said open end, whereby energy is stored in said energy storing spring means responsive to rotation of said support rod; and biases said support rod to a first position;

(d) connecting means mounting said mounting cylinder on said threaded support rod in said axially adjustable relation between a first extended position when said support rod is in said first position and a selected second one of a plurality of partially retracted positions wherein said spring means is in an energy storing position, said connecting means comprising:

(i) a first threaded drive nut engaging said threaded support rod and movable axially in response to axial movement of said mounting cylinder whereby axial movement of said mounting cylinder from said extended position is translated into rotation of said support rod through said drive nut;

(ii) a locking means for locking said drive nut at a selected retracted position; and (e) clutch means operable from outside said mounting cylinder for locking said drive nut in said selected position.

11. The support column according to claim 10, wherein said energy storing spring means comprises a spirally wound power spring having one end secured to said support rod and the other end connected to said support tube.

12. The support column according to claim 10, wherein said threaded support rod comprises a "diamond thread" along at least a portion of its length.

13. The support column according to claim 12, wherein said locking means of said connecting means comprises a threaded locking nut having threads formed therein opposite to the threads of said drive nut, whereby frictional engagement of said locking nut with said drive nut prevents rotation of said support rod in either direction, said clutch means including an activating means having a handle protruding outwardly of said mounting cylinder for selectively separating said drive nut and said locking nut when adjustment is desired.

14. The support column according to claim 10, wherein said support tube includes a support washer secured to the lower end thereof, said support washer including a central opening therein through which the lower end of said support rod freely extends for rotatable movement therein, and a securing means attaching said support rod to said support washer in such a way as to allow rotation, but impede longitudinal displacement of said support rod relative to said support washer.

* * * * *